US006123600A

United States Patent [19]

Yuen

[11] Patent Number: 6,123,600

[45] Date of Patent: Sep. 26, 2000

[54] MOTOR DRIVEN SURFACE ENGAGING MULTI-DIRECTIONAL AND SURFACE TRANSLATING AMUSEMENT DEVICE

[76] Inventor: Po Man Yuen, 159 Sanford Blvd., West, 3/FL, Mount Vernon, N.Y. 10552

[21] Appl. No.: 09/248,976

[22] Filed: Feb. 12, 1999

Related U.S. Application Data

[60] Provisional application No. 60/114,964, Jan. 5, 1999.

[51] Int. Cl.[7] ..... A63H 17/00; A63H 17/28; A63H 11/12

[52] U.S. Cl. ..... 446/437; 446/438; 446/439; 446/443; 446/272; 446/280

[58] Field of Search ..... 446/237, 238, 446/242, 256, 259, 454, 456, 437, 272, 280

[56] References Cited

U.S. PATENT DOCUMENTS

| | | |
|---|---|---|
| D. 175,475 | 8/1955 | Oswald . |
| D. 191,171 | 8/1961 | Morgan . |
| D. 212,483 | 10/1968 | Harness . |
| D. 241,872 | 10/1976 | Dunbar et al. . |
| D. 253,668 | 12/1979 | Takasaka . |
| D. 258,902 | 4/1981 | Strickland . |
| D. 262,392 | 12/1981 | Murasaki . |
| D. 316,734 | 5/1991 | Tak . |
| D. 317,799 | 6/1991 | Tapdrup . |
| D. 332,818 | 1/1993 | Spirk, Jr. et al. . |
| D. 334,954 | 4/1993 | Calhoun . |
| D. 395,930 | 7/1998 | Leadbetter . |
| 2,921,408 | 1/1960 | Leblic . |
| 2,922,929 | 1/1960 | Cooper et al. . |
| 3,984,939 | 10/1976 | Wolgamot . |
| 4,112,615 | 9/1978 | Ishimoto . |
| 4,272,918 | 6/1981 | Inoue . |
| 4,290,228 | 9/1981 | Goldfarb et al. . |
| 4,373,290 | 2/1983 | Goldfsrb et al. . |
| 4,443,967 | 4/1984 | Jones et al. . |
| 4,556,392 | 12/1985 | Chang . |
| 4,673,371 | 6/1987 | Furukawa . |
| 4,795,395 | 1/1989 | Oishi et al. . |
| 4,846,758 | 7/1989 | Chou . |
| 5,046,983 | 9/1991 | Suzuki . |

*Primary Examiner*—Kien T. Nguyen
*Assistant Examiner*—Kevin Hughes
*Attorney, Agent, or Firm*—Shlesinger, Arkwright & Garvey LLP

[57] ABSTRACT

A motor driven surface engaging multi directional and surface translating amusement device which simulates a creature of the sea or land, or a robot which has forward, reverse or rotational movement across a surface and which forward and reverse movement may be interval-cycling timed including forward-reverse speed control.

25 Claims, 5 Drawing Sheets

MOTOR DRIVEN SURFACE ENGAGING MULTI-DIRECTIONAL AND SURFACE TRANSLATING AMUSEMENT DEVICE

RELATED APPLICATION

This application is based on Provisional Application filed Jan. 5, 1999, Ser. No. 60/114,964.

FIELD OF THE INVENTION

This invention relates to motor driven surface engaging multi directional and surface translating amusement devices such as toys and particularly simulated toys including land and sea animals and more specifically to an octopus.

BACKGROUND OF THE INVENTION

Toys and other amusement devices have mechanisms for moving the device forward or backward over a surface utilizing a friction engaging wheel. The art is replete with vehicle type devices which have intermittent reverse mechanisms for causing the vehicles to spin around subsequent to traveling in a forward direction on all wheels. The prior art also has toys which perform various actions including crawling, walking and the like such as Kikuchi U.S. Pat. No. 4,795,395, Chang U.S. Pat. No. 4,556,392 and Suzuki U.S. Pat. No. 5,046,983. In the area of apperance, attention is called particularly to TAK Des. 316,734.

OBJECT AND SUMMARY OF THE INVENTION

It is an object of this invention to provide a motor driven surface engaging multi directional and surface translating amusement device which is sturdy and self propelled:

Another object of this amusement device is to provide a motion to the device which simulates that of an octopus:

A further object of this invention is to provide an amusement device with a power source utilizing batteries.

Yet another object of this invention is to provide an amusement device which can be operated remotely by signal transmission or by actual contact with the device to cause the action to go from a first phase to a second phase including a first direction and a second direction.

A further object of this amusement device is to provide a timing and speed control mechanism which will allow the device to move at different speeds and for different periods of time.

Still a further object of this invention is to provide a motor driven surface engaging multi directional and surface translating device which produces a unique sound during operation;

A still further object of this invention is to provide an octopus toy in which the toy moves and is controlled by a motor drive and which includes moving tentacles which are free moving and not directly associated with a motor drive in order to simulate the movements of an octopus. The following description accompanied by the following drawings provide details of the invention:

BRIEF DESCRIPTIONS OF THE DRAWINGS

DETAILED DESCRIPTION OF THE INVENTION

FIG. 1

Figure 1:
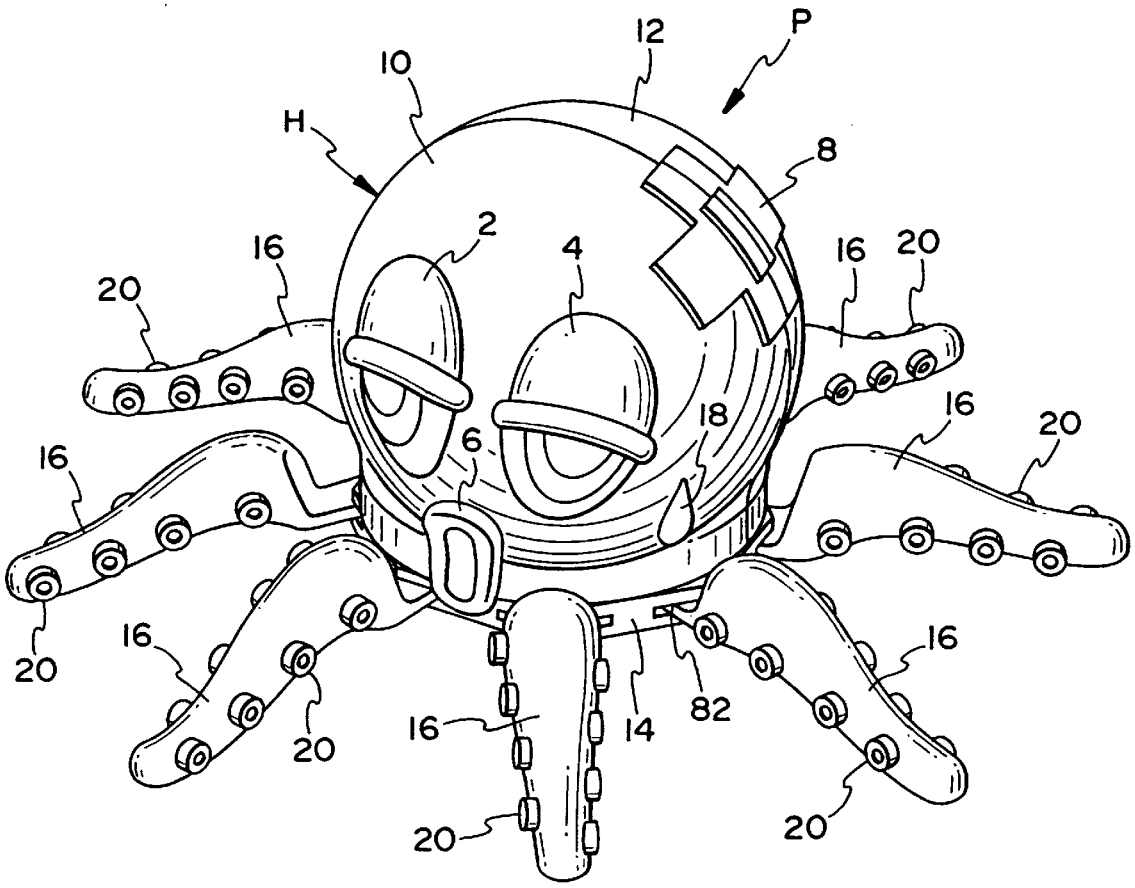
FIG. 1 is a perspective view of the amusement device simulating an octopus.

FIG. 1 shows a simulated octopus P. The simulated octopus P includes eyes 2 and 4 and a mouth or a beak 6. A bandage 8 is provide to give the simulated octopus P a unique appearance. The simulated octopus P includes a housing H comprised of connected shell members 10 and 12. A ring gear 14 supports a series of tentacles 16. Decorative ear pieces such as shown at 18 on the left side of the simulated octopus P are provided to enhance the visual effect. Further to enhance the visual effect, simulated suckers 20 are provided on the tentacles 16.

FIGS. 2–5

Figures 2, 3:
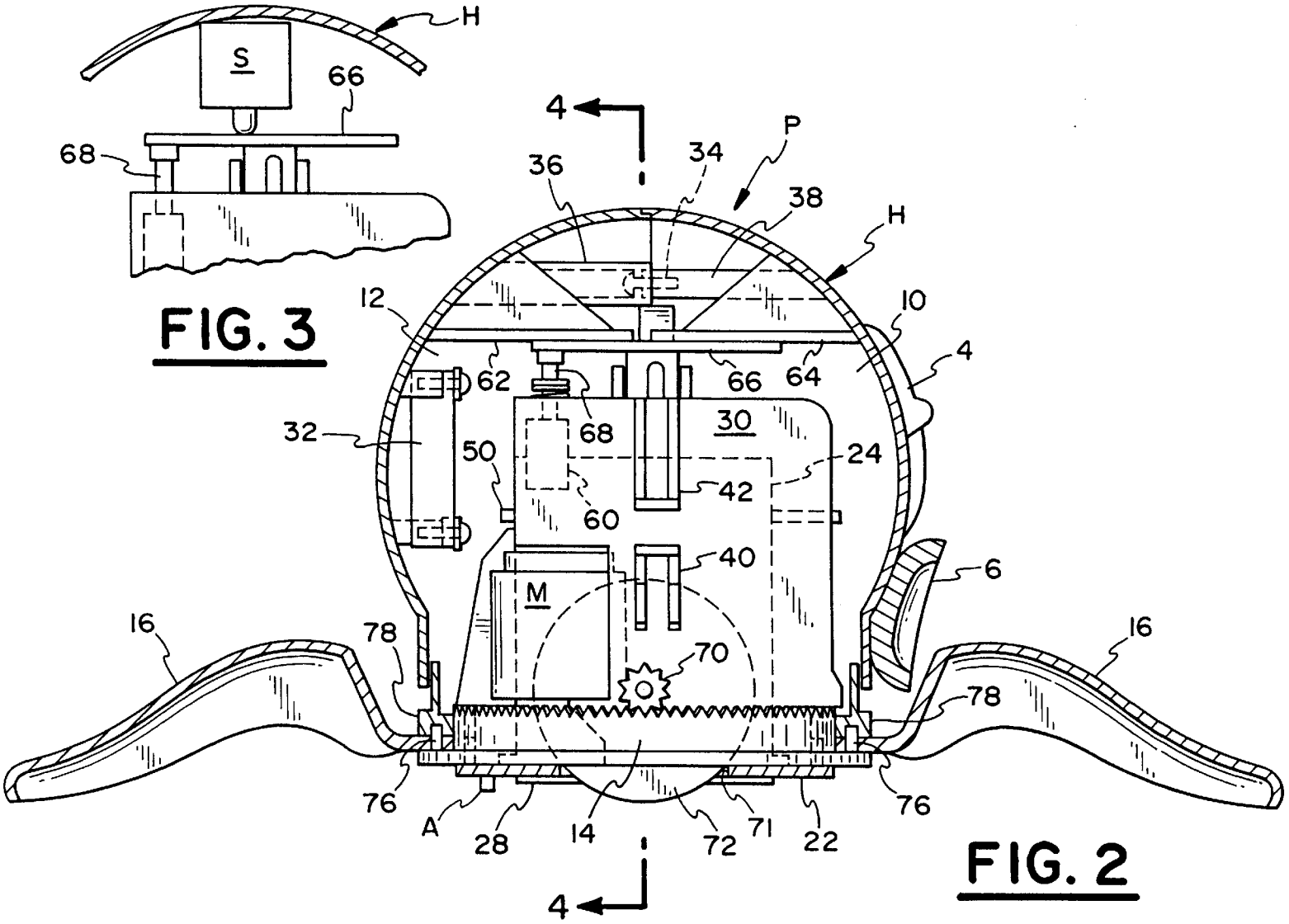
FIG. 2 is a cross sectional view of the simulated octopus.
FIG. 3 is a fragmentary sectional view showing a portion of the reversing travel mechanism.

FIG. 2 shows a substantially circular base platform 22 includes an upper surface 23 and lower surface 23', and. Base platform 22 supports a battery compartment 24 housing batteries 26 best shown in FIG. 4. The battery compartment 24 includes a removable cap 28 to lock the batteries 26 therein. An on/off 29 is located on the lower surface 23'.

The base platform 22 supports a transmission 30 which may be of any typical forward-reverse transmission utilizing a combination of varying sizes and shapes of gears and cams (not shown) but illustrated in the provisional application aforementioned.

Figure 4:
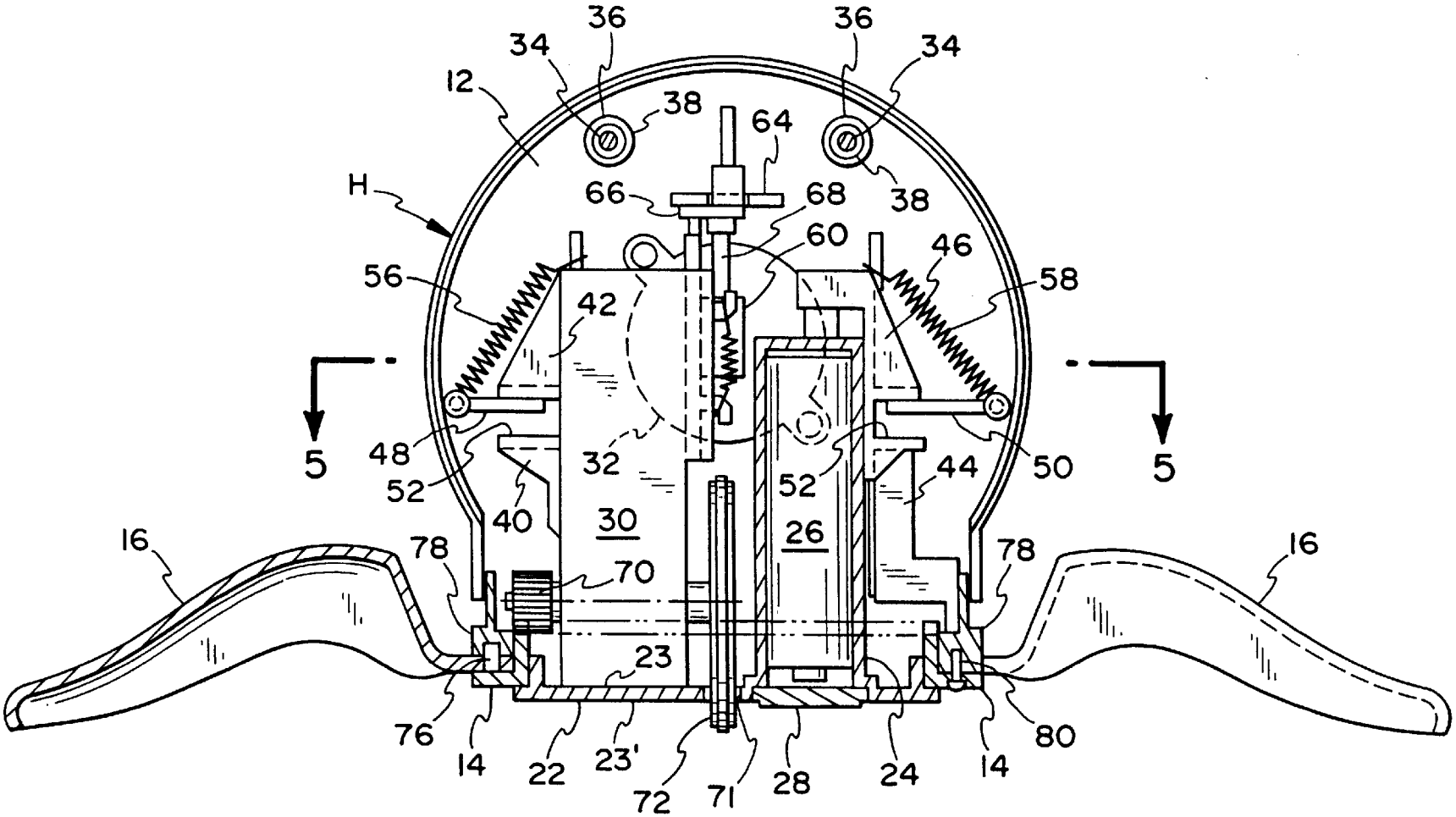
FIG. 4 is a cross sectional view of the simulated octopus taken along the lines 4—4 of FIG. 2 and viewed in the direction of the arrows.
Figure 5:
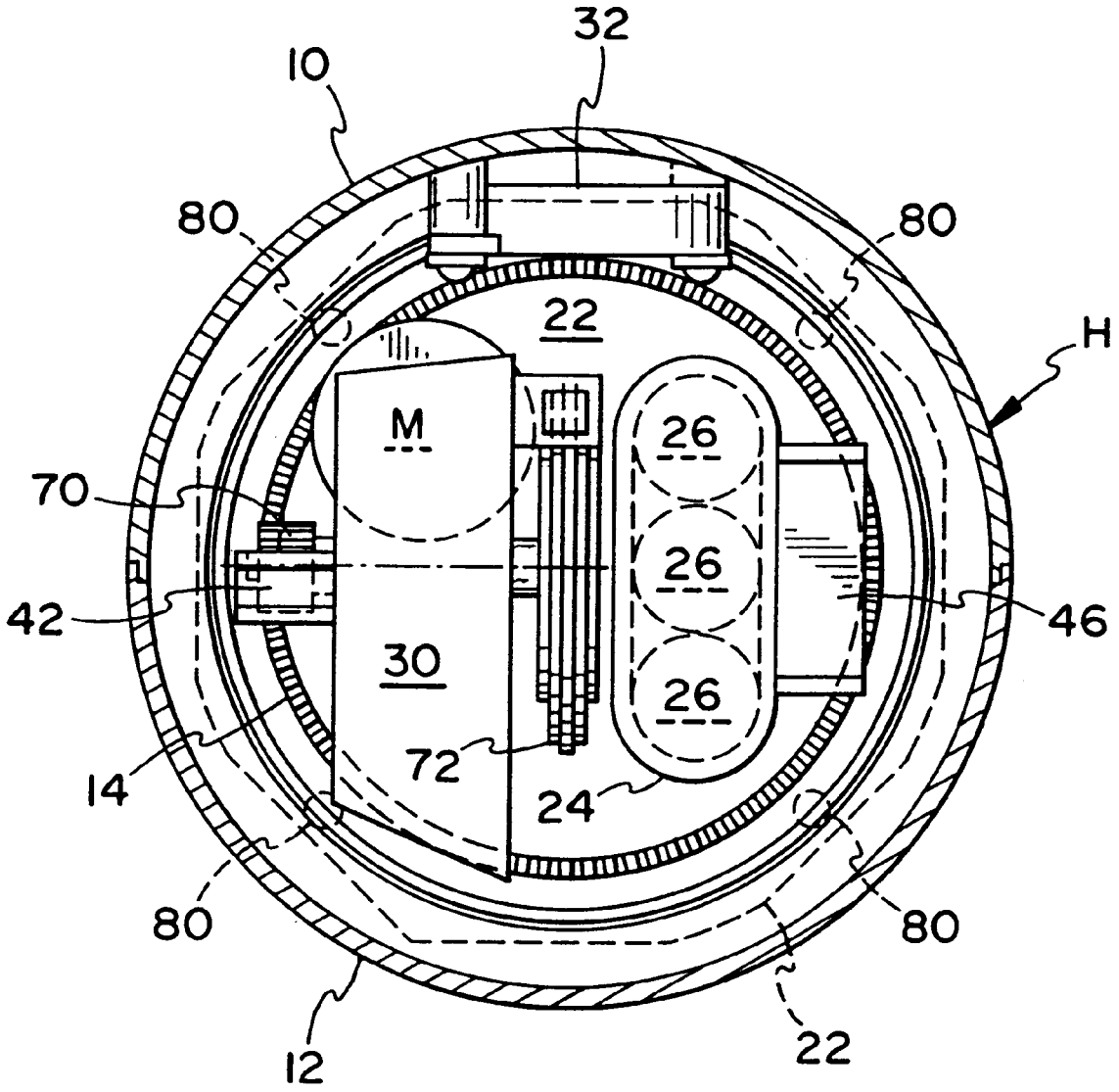
FIG. 5 is a cross sectional view of the simulated octopus shown in FIG. 4 and viewed in the direction of the arrows.

Secured to the shell 12 is a speaker or light or combination of speaker and light 32. The speaker or light or combination speaker and light 32 are connected by wires (not shown) to the source of power, batteries 26. Bolts 34 are provided in sleeves 36 and 38 for clamping the shells 10 and 12 together. The base platform 22 through the transmission 30 and battery compartment 24 supports upper and lowers slot forming members 40, 42, 44 and 46, shown in FIG. 4. Shells 10 and 12 are provided with flanges 48 and 50 as best shown in FIG. 4, which engaged the slots 52 and 54 of the slot forming members 40, 42, 44 and 46 so that when the shells 10 and 12 are bolted together, they will be held by the support platform 22, but allowed to move vertically relative to support platform 22 in the slots 52 and 54 as will be here-and-after described. Tension springs 56 and 58 maintain the shells 10 and 12 in the upward position in the slots 52 and 54 under normal conditions.

As best shown in FIG. 2, a reverse spring loaded micro-switch 60 is provided on the base support 22. Plates 62 and 64 are fixed to the shells 10 and 12. Beneath plates 62 and 64 is a pressure plunger 66 which engages the pin 68 of the micro-switch 60 when the shells 10 and 12 are downwardly depressed by manually pushing downward on the shells or by utilizing a stick or the like to push down on the shells 10 or 12.

Figure 6:
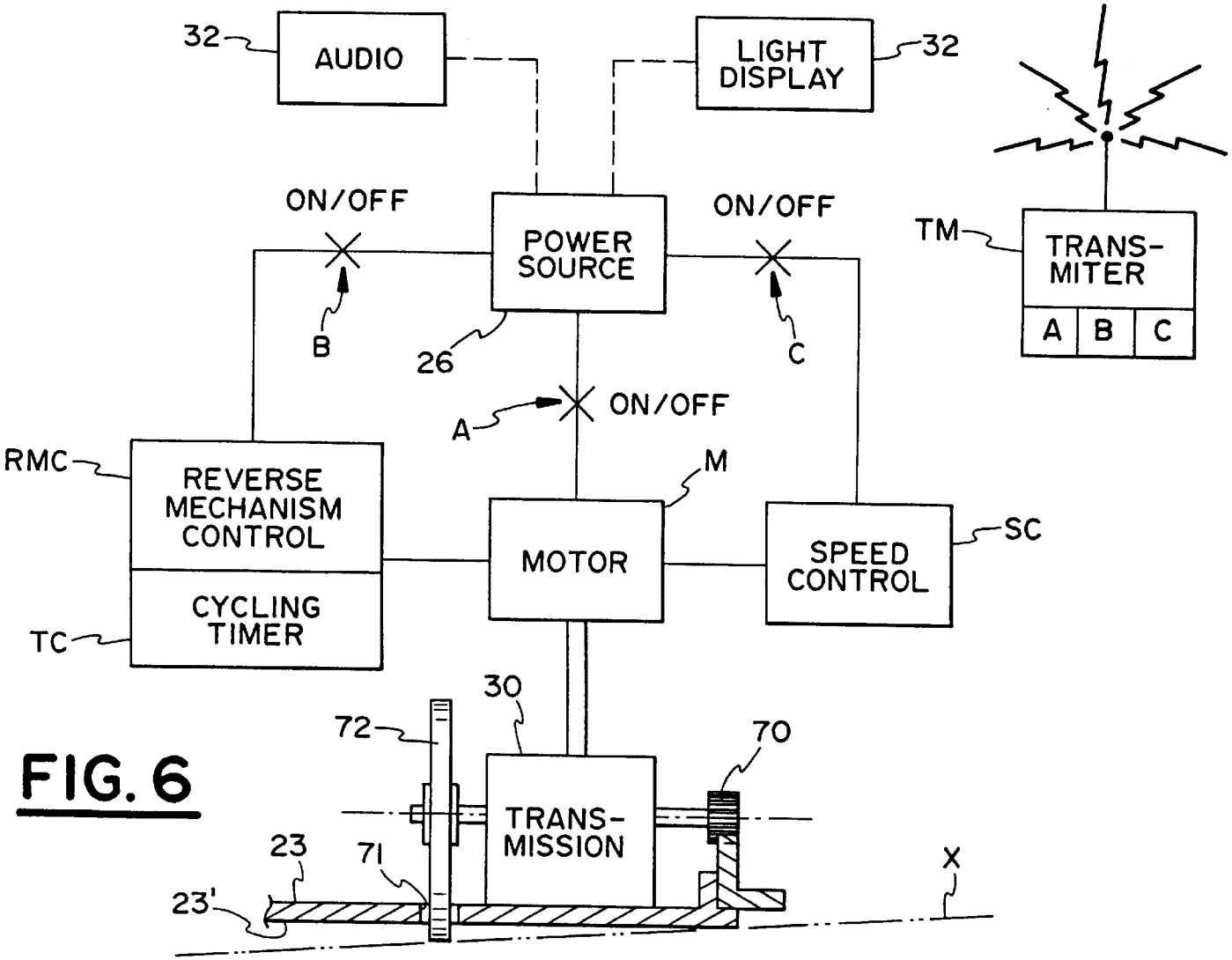
FIG. 6 is a schematic showing the sequencing system used in the octopus of FIG. 1 including a portion of the drive mechanism shown in cross section.

Motor M, best shown in FIG. 2, includes means (not shown) for driving the pinion 70 and in slot 71, the friction drive wheel 72. Slot 71 is centrally positioned in the base platform 22 (FIGS. 2, 4 and 6). Ring gear 74 is engaged by the pinion 70. The ring gear 14 includes pins 76 which support the appendages, namely the tentacles 16. An upper annular plate 78 forms a part of the ring gear 14 and is secured thereto by screws 80 best shown in FIG. 4. Plate 78 is mounted on the periphery of base platform 22. The tentacles 16 swing freely on pins 76 in slots 82 as best shown in FIG. 1. Referring now to FIG. 3, a solenoid S may be provided in the housing H for depressing the pressure plunger 66 against the micro-switch pin 68 to reverse drive of the ring gear 14.

It is to be noted that the friction drive wheel 72 has its plane transverse to the plane of the face on shell 10; namely, the eyes 2, 4 and the beak 6.

OPERATION-FIG. 6

To operate the simulated octopus P or other simulated devices on surface X utilizing the invention as set out, the on/off A turns the power on from the power source 26 to the motor M. It may also turn on the light display and audio or combination of both 32. In the mechanical version just described, pushing down on the housing H will cause transmission 30 to mechanically reverse through mechanical linkages well known by a cam operation. Using a transmitter TM, and activating the on/off A and the on/off B, the reverse mechanism control RMC will cause the motor M to drive in a reverse direction and therefore the transmission 30 to reverse the friction drive wheel 72 as well as the pinion 70 so that the ring gear will reverse direction and the device will change direction of travel. The unit is also controlled by a Speed Control through an on/off C from the transmitter TM, which can either slow down or increase the speed of the motor M as desired.

A time control TC can be used to maintain a direction of travel for a set period. The gear train in housing H can be so designed as to include a segment gear or a cam mechanism (not shown) to change the direction of travel of the friction drive 72 as well as the pinion 70. This can also be controlled by the on/off C which will permit change in the speed control SC through the transmitter TM.

It will now be obvious that various actions of the simulated octopus P can be worked out depending upon the gearing in the reverse mechanism RM and speed control SC, and time control TC relative to the transmission 30 or motor M drive.

To be more specific in the operation, when motor M is turned on, friction wheel 72 and pinion 70 will rotate in the same direction. The pinion 70 will drive the ring gear 14 in a rotational direction at a speed determined by the Speed Control, thus moving the octopus P in a first rotary direction because of a tilt of the base platform 22 and frictional engagement with the surface X on which the octopus P is placed. When housing H is depressed creating tension on the springs 56 and 58, the drive motor M will be reversed causing the pinion 70 and friction wheel 72 to rotate in reverse direction. The pinion 70, now rotating in a second direction, will cause the ring gear 14 to rotate in the reverse direction to which it was initially. The speed of the rotation will dependent upon the Speed Control SP and for a period of time which is set byte reverse mechanism control RMC and the time control TC.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A motor driven surface engaging multi-directional and surface translating amusement device comprising:

a) a substantially annular base platform having upper and lower surfaces and a central portion;

b) a motor mounted on said platform;

c) said base platform including a power source for said motor;

d) said base platform having a slot in said central position;

e) said base platform having a ring gear rotatably mounted thereon;

f) said base platform supporting a forward-reverse transmission;

g) said base platform supporting a friction drive wheel mounted in said slot and extending a substantial distance therethrough for active engagement with a surface;

h) said forward-reverse transmission connected to said motor and driven thereby;

i) said forward-reverse transmission including a ring gear pinion engaging and drawings said ring gear;

j) said friction drive wheel connected to said forward-reverse transmission and driven thereby;

k) said ring gear having appendages mounted on and extending therefrom movable on said ring gear to produce an action effect to said amusement device when driven;

l) on/off mechanism for activating said motor to drive said forward-reverse transmission and in turn said ring gear pinion and said friction device wheel to cause said amusement device to translate the surface on which said amusement device is placed when said on/off mechanism is on;

m) means for activating said forward-reverse mechanism to change the direction of travel; and n) said base platform including a housing which is vertically movable into a distinct up position and a distinct down position relative to said base platform and including means for activating said forward/reverse mechanism to change the direction of travel when said housing is either in the up or down position.

2. A motor driven surface engaging and surface translating amusement device as in claim 1, and wherein:

a) said housing encompasses said motor, said power source, said forward-reverse transmission, and said on/off mechanism.

3. A motor driven surface engaging and surface translating amusement device as in claim 2, and wherein:

said housing encircles at least a portion of said ring gear.

4. A motor driven surface engaging and surface translating amusement device as in claim 2, and wherein:

a) said ring gear includes an annular slot; and b) said housing includes a lip engageable in said ring gear annular slot and movable therein.

5. A motor driven surface engaging and surface translating amusement device as in claim 3, and wherein:

a) said housing lip is movable a distance up and down in said ring gear annular slot and is rotable therein.

6. A motor driven surface engaging and surface translating amusement device as in claim 5, and wherein:

a) said housing comprises a pair of separable connected shells.

7. A motor driven surface engaging and surface translating amusement device as in claim 6, and wherein:

a) one of said pair of connected shells includes a face.

8. A motor device surface engaging and surface translating amusement device as in claim 7, and wherein:

said face lies in a place transverse to the plane of said slot and said friction derive wheel.

9. A motor driven surface engaging and surface translating amusement device as in claim 1, and wherein:

a) said base platform includes interval-cycling timing means for reversing said transmission to cause said amusement device to change direction when being driven.

10. A motor driven surface engaging and surface translating amusement device as in claim 9, and wherein:

a) said interval-cycling timing is mechanical.

11. A motor driven surface engaging and surface translating amusement device as in claim 1, and wherein:

a) said ring gear includes upper and lower interconnectable plates for supporting said appendages.

12. A motor driven surface engaging and surface translating amusement device as in claim 11, and wherein:

a) at least one of said upper and lower plates includes pins for supporting said appendages.

13. A motor driven surface engaging and surface translating amusement device as in claim 12, and wherein:

a) said other of said upper and lower plates providing additional slots adjacent said pins for receiving said appendages.

14. A motor driven surface engaging and surface translating amusement device as in claim 13, and wherein:

a) said housing simulates an octopus body; and b) said appendages simulates an octopus legs.

15. A motor driven surface engaging and surface translating amusement device as in claim 1, and wherein:

a) said base platform includes means for accessing said power source.

16. A motor driven surface engaging and surface translating amusement device as in claim 1, and wherein:

a) said base platform has an upper and lower surface; and b) said lower surface includes said on/off mechanism.

17. A motor driven surface engaging and surface translating amusement device as in claim 5, and wherein:

a) said base platform includes means engageable with said housing for reversing said forward-reverse transmission when said housing lip is moved down in said ring gear slot.

18. A motor driven surface engaging and surface translating amusement device as in claim 17, and wherein:

a) said base platform and said housing include spring means for normally maintaining said housing up in said ring gear annular slot for drive in one direction.

19. A motor driven surface engaging and surface translating amusement device as in claim 1, and including:

a) signal receiving means for activating said on/off mechanism.

20. A motor driven surface engaging and surface translating amusement device as in claim 18, and including:

a) a solenoid for moving said housing downward in said ring gear annular slot.

21. A motor driven surface engaging and surface translating amusement device as in claim 18, and wherein:

a) said base platform includes a speaker system.

22. A motor driven surface engaging and surface translating amusement device as in claim 1, and wherein:

a) said base platform includes-speed control.

23. A motor driven surface engaging and surface translating amusement device as in claim 1, and wherein:

a) said base platform includes a light source for illuminating said amusement device.

24. A motor driven surface engaging and surface translating amusement device as in claim 22, and wherein:

a) said speed control is coupled to said motor.

25. A motor driven surface engaging and surface translating amusement device as in claim 22, and wherein:

a) said speed control is coupled to said forward-reverse transmission.

* * * * *